US008642858B2

(12) United States Patent
Donnellan

(10) Patent No.: US 8,642,858 B2
(45) Date of Patent: Feb. 4, 2014

(54) STRING INSTRUMENT HAVING A BASEBALL BAT BODY

(76) Inventor: Glenn Donnellan, Alexandria, VA (US)

( * ) Notice: Subject to any disclaimer, the term of this patent is extended or adjusted under 35 U.S.C. 154(b) by 0 days.

(21) Appl. No.: 13/070,753

(22) Filed: Mar. 24, 2011

(65) Prior Publication Data

US 2011/0232464 A1 Sep. 29, 2011

Related U.S. Application Data

(60) Provisional application No. 61/317,104, filed on Mar. 24, 2010.

(51) Int. Cl.
*G10D 3/00* (2006.01)

(52) U.S. Cl.
USPC ..... 84/291

(58) Field of Classification Search
USPC ..... 84/267, 290, 291, 293
See application file for complete search history.

(56) References Cited

U.S. PATENT DOCUMENTS

| | | | | |
|---|---|---|---|---|
| 3,853,032 | A * | 12/1974 | Freeman | 84/275 |
| 5,078,041 | A | 1/1992 | Schmued | |
| 5,461,185 | A | 10/1995 | Forsberg et al. | |
| 5,817,966 | A | 10/1998 | Fishman | |
| 2005/0160897 | A1 * | 7/2005 | Hirayama | 84/307 |
| 2006/0096439 | A1 * | 5/2006 | McPherson | 84/290 |
| 2007/0180976 | A1 * | 8/2007 | Demsey et al. | 84/315 |

* cited by examiner

*Primary Examiner* — Kimberly Lockett
(74) *Attorney, Agent, or Firm* — Millen, White, Zelano & Branigan, P.C.

(57) ABSTRACT

A string musical instrument is provided such as a violin comprising a body in the shape of the baseball bat.

6 Claims, 5 Drawing Sheets

STRING INSTRUMENT HAVING A BASEBALL BAT BODY

This application claims the benefit of the filing date of U.S. Provisional Application Ser. No. 61/317,104 filed Mar. 24, 2010, which is incorporated by reference herein.

FIELD OF THE INVENTION

The invention relates to a string instrument such as violins, violas, guitars and the like which have a body derived from a baseball bat.

BACKGROUND OF THE INVENTION

Violins in the form of a baseball bat have been disclosed in U.S. Pat. No. 3,853,032. While the '032 patent indicates the violins provided can be made from a regulation baseball bat, the bats disclosed require significant modifications including adding elements to provide a tail piece, a finger board and nut, a sound bar and a sound post. By introducing these added elements, the identity of the baseball bat is diluted or lost.

It is desirable to provide a functioning string instrument which more closely resembles a regulation baseball bat.

SUMMARY OF THE INVENTION

The present invention provides a string instrument such as a violin, viola, guitar or the like wherein required components are incorporated into the body of the instrument, which is a baseball bat, without adding additional elements.

BRIEF DESCRIPTION OF THE DRAWINGS

Various other features and attendant advantages of the present invention will be more fully appreciated as the same becomes better understood when considered in conjunction with the accompanying drawings, in which the reference characters designate the same or similar parts throughout the several views, and wherein:

A feature of the present invention is to position the strings of an instrument such that a fingerboard need not be added to the baseball bat and preferably, the bat handle itself functions as a fingerboard preferably with no shaping or contouring of the fingering surface. In certain embodiments, fret lines may be painted on the bat handle to aid finger location. FIGS. 6A and 6*b* show frets lines 635. In other embodiments, such as where the string instrument is a guitar, fret wires (not shown) may be inlaid in the bat handle to provide a raised surface without changing the outer diameter of the bat handle itself.

One aspect of the present invention is to provide a string instrument comprising a body which is a baseball bat wherein the fingerboard is integrated into the body.

The fingerboard preferably comprises a fingering region 10 in the handle of said baseball bat. In preferred embodiments, the handle of the baseball bat is unmodified and is the fingerboard.

The string instruments of this invention also include a plurality of strings removably attached to said body which extend along the finger board, which is preferably a fingering region 10 of the handle of the baseball bat.

Figure 1A:
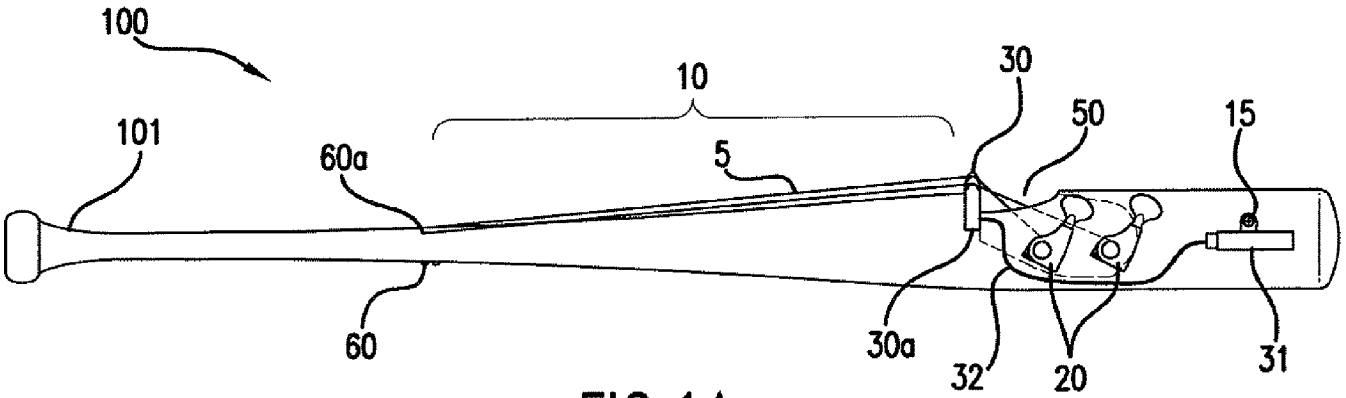
FIG. 1A is a side view of a violin of this invention.
Figure 1B:
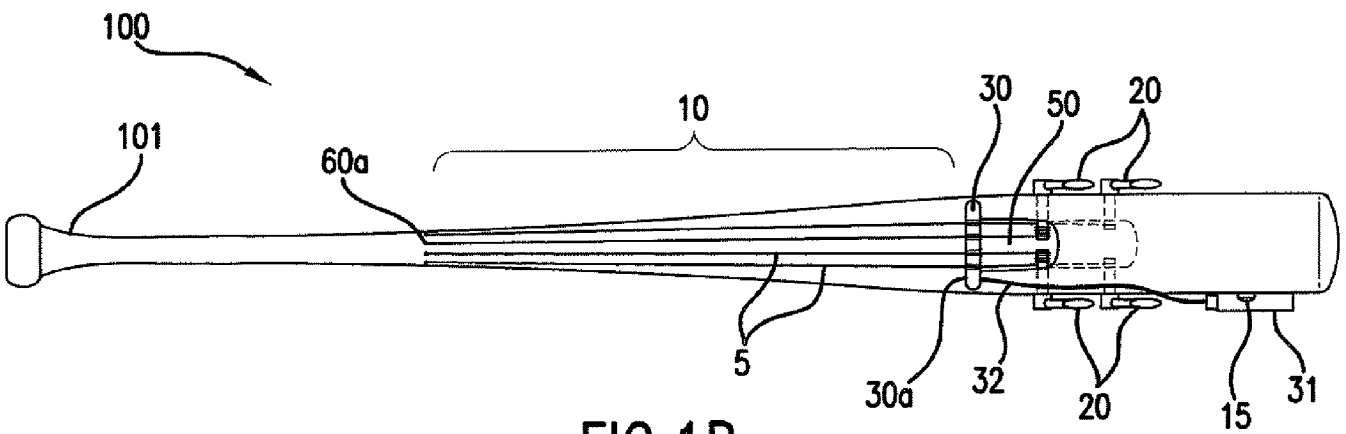
FIG. 1B is a top view of the violin of FIG. 1A.

For violin 100 of FIGS. 1A and 1B, this is accomplished through the placement of the tuner pegs 20 on the side of the bridge 30, opposite the fingering region 10. Violins 200 and 300 of FIGS. 2A, 2B, 3A and 3B have a similar configuration. This configuration is reversed from the position of the tuner pegs in traditional acoustic violins and the violin of U.S. Pat. No. 3,853,032. Preferably the tuner pegs 20 are positioned (recessed) in the bat head as shown in FIGS. 1A and 1B to preserve the profile of the baseball bat as much as possible. In preferred embodiments, guitar or banjo tuners are used as tuners pegs instead of the wooden pegs used in traditional violins primarily for their small size. In violin 100 of FIGS. 1A and 1B, and violin 200 of FIGS. 2A and 2B, guitar/banjo tuners are used for tuner pegs 20 and 220, respectively. In violin 300 of FIGS. 3A and 3B, the tuner pegs 320 are completely recessed in the bat head so as to preserve more of the profile of the baseball bat. In guitar 600 of FIGS. 6A and 6B, guitar tuners are used for tuner pegs 620.

Another element that is preferably incorporated in the baseball bat body is the tailpiece of traditional string instruments. In violin 100 of FIGS. 1A and 1B, this is accomplished by securing the strings 5 directly to the baseball bat body 101 by passing them through hole 60*a* in the bat handle above finger board region 10 such that the ball ends 60 of the strings are imbedded in the handle. Violins 200 and 300 of FIGS. 2A, 2B, 3A and 3B have a similar configuration of holes 260*a* and 360*a* for strings with optionally imbedded ball ends 260 and 360. Guitar 600 of FIGS. 6*a* and 6B also has a similar configuration of holes 660*a* for strings with ball ends 660.

Figure 6A:
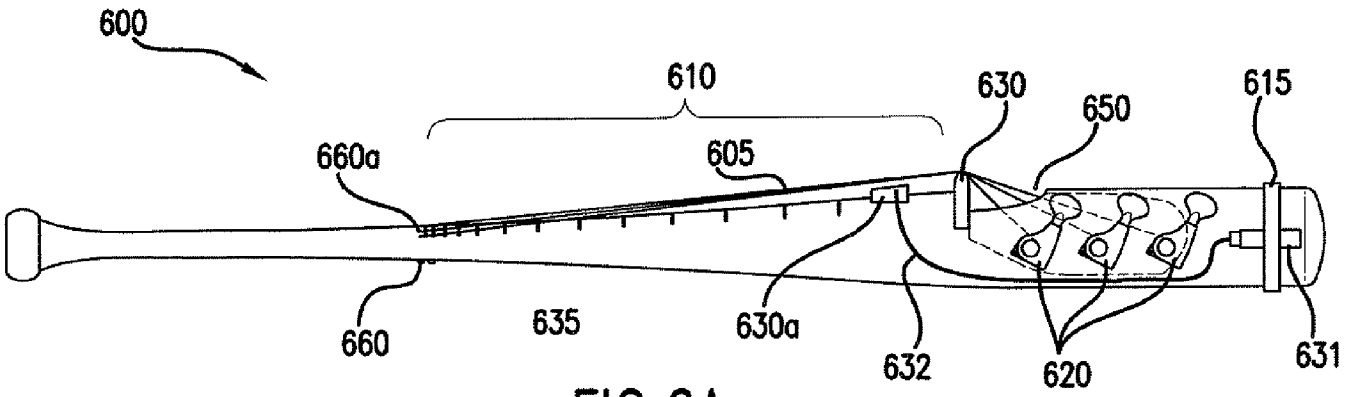
FIG. 6A is a side view of a guitar of this invention.
Figure 6B:
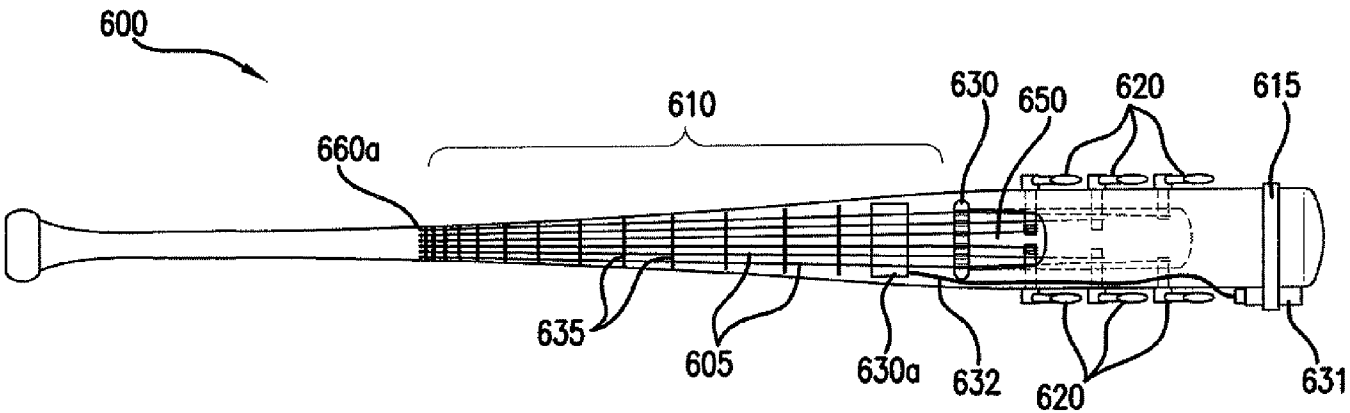
FIG. 6B is a top view of the guitar violin of FIG. 2A.

The strings conform in number to the number used in traditional string instruments of the same type. For example, violin 100 of FIGS. 1A and 1B has four strings 5 that are connected to four tuner pegs 20; violin 200 of FIGS. 2A and 2B has five strings 205 connected to five tuner pegs 220. Violin 300 also has four strings 305 connected to four recessed tuner pegs 320. While violins are illustrated in FIGS. 1A, 1B, 2A, 2B, 3A and 3B, the string instruments of the present invention include violas, guitars, banjos, mandolins, cellos, ukuleles and dulcimers when fitted with the appropriate strings. FIGS. 6A and 6B show a guitar 600 having six strings 605, six tuner pegs 620 and frets 640, which can be painted on the bat handle or inlaid fret wire.

The strings preferably conform in length and spacing to that of traditional string instruments of the same type. This will enable traditional strings to be used in the string instruments of the present invention. In FIGS. 1A, 1B, 2A, 2B, 3A, 3B, 6A and 6B the holes 60*a*, 260*a*, 360*a* and 660*a*, preferably define a length and spacing consistent with a traditional violin, viola or guitar. More preferably, the holes 60*a*, 260*a* and 360*a* and the bridge (30, 230 and 330) define a fingering region (10, 210 and 310) with a length consistent with the finger board of a traditional violin or viola. For guitar 600 of FIGS. 6A and 6B, the bridge 630 raises the strings above the pickup 630*a*.

The strings may be removably attached to the baseball bat body in a variety of different configurations. As indicated above, the configuration which provides the same string spacing as a traditional string instrument (violin, viola, guitar, banjo, mandolin, cello, ukulele, dulcimer, etc.) is preferred.

Figures 4, 5:
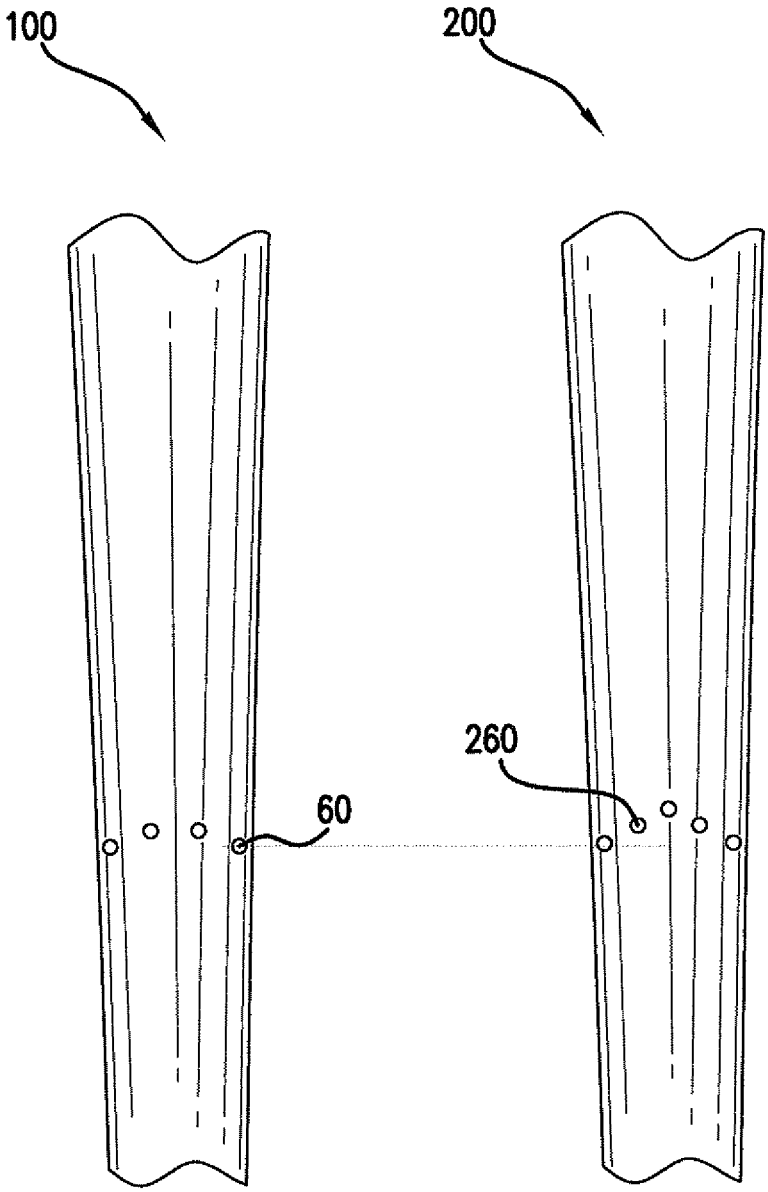
FIG. 4 is a plain view of a portion of the violin of FIG. 1A where the strings are removably attached to the bat in the back of the violin.
FIG. 5 is a plain view of a portion of the violin of FIG. 2A where the strings are removably attached to the bat in the back of the violin.

FIGS. 4 and 5 illustrate the back of the bat where the strings are attached. FIG. 4 is the pattern for a four string violin of FIGS. 1A and 1B and a FIG. 5 is the pattern for a five string violin of FIGS. 2A and 2B.

The string instrument of the present invention may be tuned to any pitch within the parameters of the string due to the strength of the body provided by the baseball bat.

An optional feature of the string instruments of the present invention is to recess all or a portion of the tuner-pegs into the body to maintain the profile of the baseball bat. To provide access to the recessed portions of the tuner-pegs for winding the strings, an access hole is drilled into the body (baseball bat). The hole is preferably drilled between the bridge and the tuner-pegs. FIGS. 1A and 1B show access hole 50 for four strings 5. FIGS. 2A, 2B, 3A, 3B, 6A and 6B show a similar configuration with access holes 250, 350 and 650. It is contemplated these access holes may be filled with removable foam to maintain the profile of a baseball bat and maintain access to the tuner pegs. In addition, it is contemplated small access holes may be drilled for each of the strings to preserve the profile of the baseball bat.

Certain string instruments of this invention such as violins and violas require a bridge mounted to the body below the finger board. The bridge contacts a plurality of strings so they do not press down on the finger board without pressure from the human finger. Violin 100 of FIGS. 1A and 1B have a bridge 30. Violin 200 of FIGS. 2A and 2B have a bridge 230 and violin 300 of FIGS. 3A and 3B have a bridge 330. Preferably, the bridge arranges the strings in an arcuate distribution so that the strings are elevated at different positions to enable the individual strings to be bowed. In FIGS. 6A and 6B, the bridge 630 simply elevates the strings above the pickup 630*a*.

In violin 100 of FIGS. 1A and 1B, the bridge 30 is adhered directly to the surface of the baseball bat. In violin 200 of FIGS. 2A and 2B and 300 of FIGS. 3A and 3B, the baseball bat is notched and the bridge 230/330 is adhered to the bat within the notch. In stringed instruments such as a guitar, ukulele and mandolin, a bridge is not necessary if the pickup is recessed in the bat. To enhance the volume of the string instrument, it is optionally equipped with an electronic pick-up connected to the body which is the baseball bat so as to receive sounds from the plurality of strings and transmit them to an amplifier. With such a system, the body of the baseball bat need not be hollowed out to provide resonance and does not require a sound post or sounding board.

Figure 2A:
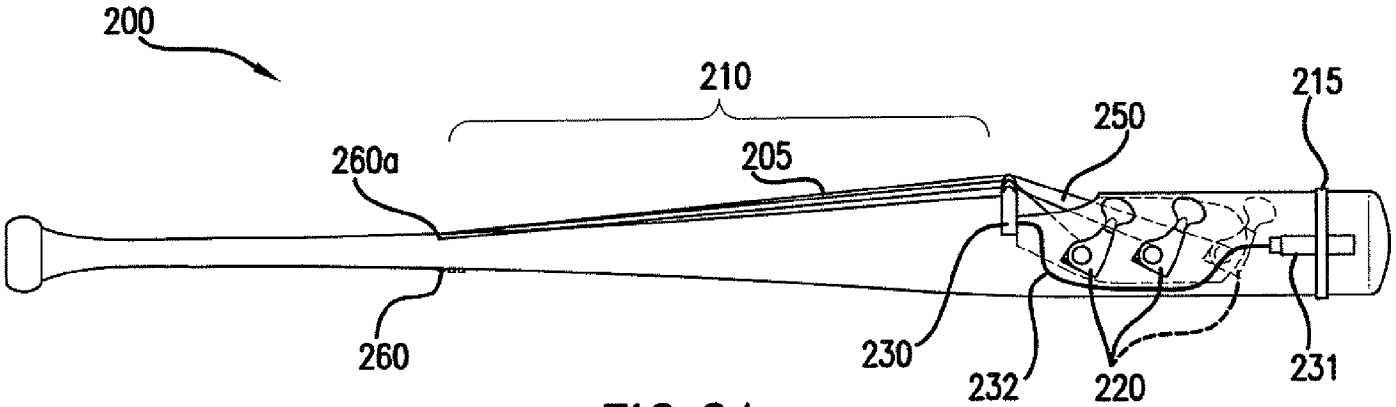
FIG. 2A is a side view of another violin of this invention.
Figure 2B:
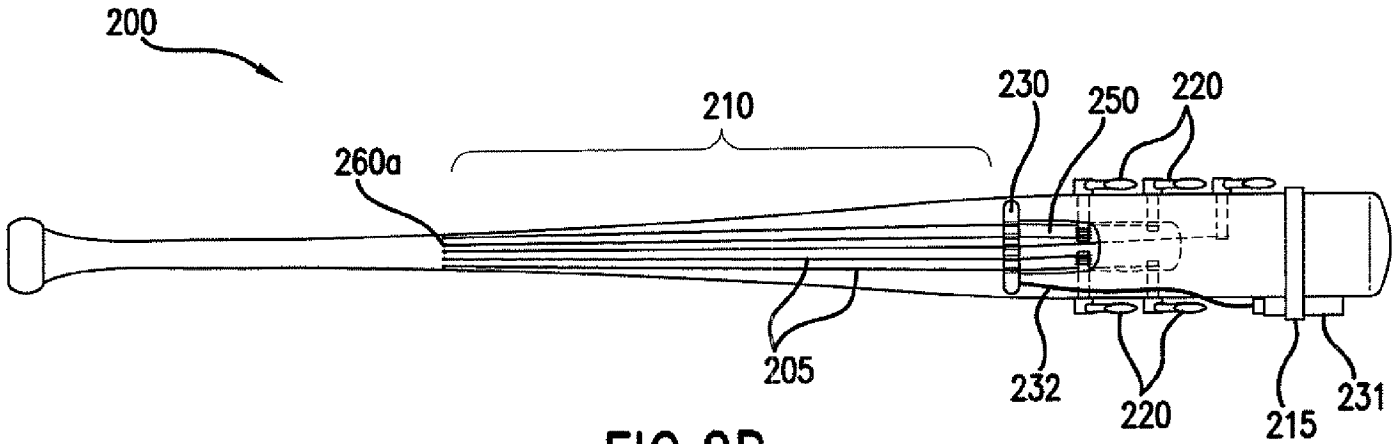
FIG. 2B is a top view of the violin of FIG. 2A.
Figure 3A:
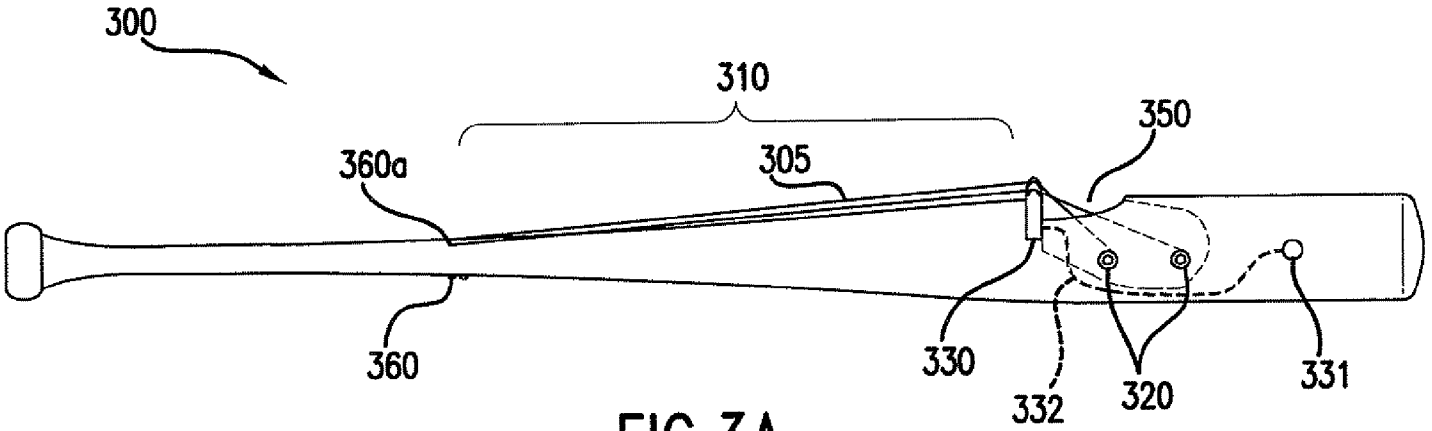
FIG. 3A is a side view of a further embodiment of a violin of this invention.
Figure 3B:
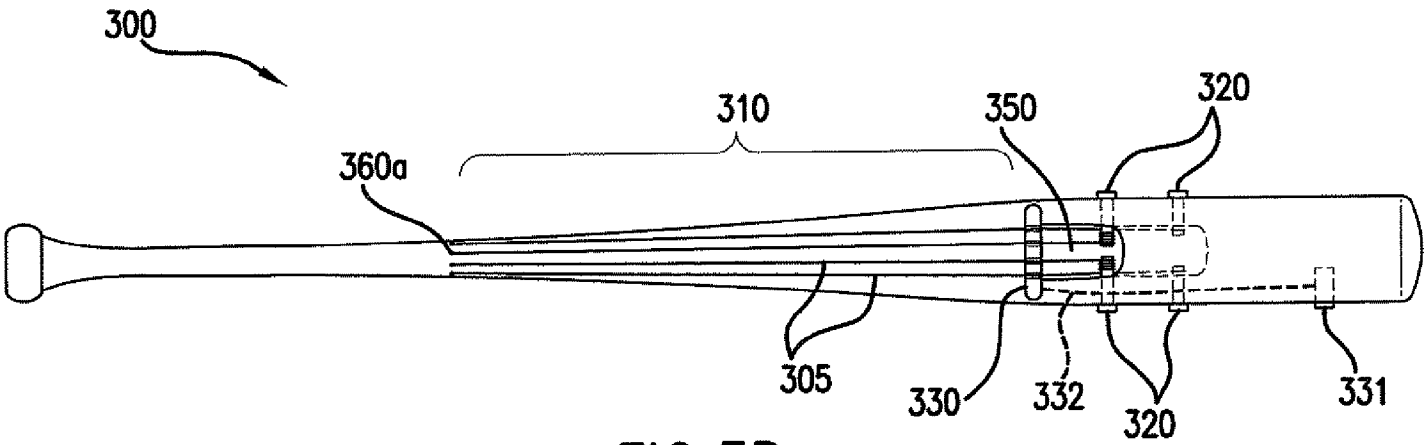
FIG. 3B is a top view of the violin of FIG. 3A.

For violin 200 of FIGS. 2A and 2B and violin 300 of FIGS. 3A and 3B, the electronic pick-up is integrated into the bridge 230/330. An example of such an electronic pick-up is an electric violin bridge transducer made by Barbera Transducer Systems. For violin 100 of FIGS. 1A and 1B, a separate electronic pick-up 30*a* is positioned under the bridge 30. For violin 100, the electronic pick-up 30*a* is electrically connected to pick-up jack 31 via pick-up wire 32. The pick-up jack 31 is preferably anchored directly to the body which is the baseball bat by screw mount 15. For violin 200 shown in FIGS. 2A and 2B, the electronic pick-up integrated in bridge 230 is electrically connected to pick-up jack 231 via pick-up wire 232. The pick-up jack 231 is secured by strap 215. For violin 300 of FIGS. 3A and 3B, the electronic pick-up is integrated in bridge 330 and is electrically connected to pick-up jack 331 via pick-up wire 332. The pick-up jack 331 is recessed in the head of the baseball bat and pick-up wire 332 is concealed in the head of the baseball bat. For guitar 600 shown in FIGS. 6A and 6B, the electronic pick-up 630*a* is electrically connected to pick-up jack 631 via pick-up wire 632. The pick-up jack 631 is secured by strap 615.

The electronic pick-up can be any of those known to be suitable for conventional electronic string instruments including electric violins, violas, guitars, banjos, mandolins, cellos, ukuleles, dulcimers, etc. The electronic pick-up can be a piezo pick-up or a magnetic pick-up. Examples of suitable electronic pick-ups are described in U.S. Pat. Nos. 5,817,966, 5,461,185 and U.S. Pat. No. 5,078,041. Those sold by Fishman, Kremona, Realist, Schertler and Schatten are also suitable. Electronic pick-ups which do not require a preamplifier are favored for some embodiments.

Magnetic pick-ups known in the art transduce the motion of individual strings into corresponding electrical signals that are provided to a sound amplifier. These magnetic pick-ups can comprise a plurality of pick-up elements (not shown) responsible for picking up the vibrations of one of the plurality of strings.

The electronic pick-up can include any of the conventional optional features including controls to set the gain as well as frequency, tone, and volume of sound transmitted from the strings to the amplifier.

Although not required, a nut (not shown) may be positioned below holes (60*a*/260*a*/360*a*/660*a*) under the strings (5/205/305/605). A nut is used to adjust the string spacing where desired.

If desirable, a chin rest can be added to the body which is the baseball bat. A drink cozy or other foam pad which surrounds the bat head serves to improve comfort and stability and is non-permanent so as not to alter the profile of the baseball bat until use.

Other optional features include the use a conventional wireless pick-up as opposed to a wired pick-up device so as to further preserve the profile of the baseball bat and improve mobility.

String instruments of this invention preferably employ a wood baseball bat as a body but an aluminum alloy, composite or plastic bat can be used. Preferably, bats made by Louisville Slugger® are used to enhance the association of the musical instrument with major league baseball. The baseball bat used need not be regulation baseball bat and need not be suitable for playing baseball at any level. The body need only simulate a baseball bat. It does not need to function as a baseball bat but preferably does.

To prepare a string instrument of this invention such as a violin 100 of FIG. 1, holes 60*a* are drilled into the handle of the baseball bat 101 for strings 5. Typically four to five strings are used and threaded through the holes until the ball head 60 is reached. Two or three holes are then drilled for the tuner-pegs 20. The bridge 30 and pickup 30*a* are adhered to the baseball bat 101 and an access hole is 50 is cut so the strings 5 can attach to the tuner-pegs 20. The strings 5 are wound on the tuner-pegs to the desired tension over the bridge and the instrument is prepared to play with a conventional bow. The guitar 600 of FIGS. 6 A and 6B is stringed similarly but pained frets or fret wires are preferably added and the bridge does not arch the strings for bowing.

From the foregoing description, one skilled in the art can easily ascertain the essential characteristics of this invention, and without departing form the spirit and scope thereof, can make various changes and modifications of the invention to adapt it to various usages and conditions.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The entire disclosures of all applications, patents and publications, cited herein and of corresponding U.S. Provisional Application Ser. No. 61/317,104, filed Mar. 24, 2010, are incorporated by reference herein.

The preceding examples can be repeated with similar success by substituting the generically or specifically described reactants and/or operating conditions of this invention for those used in the preceding examples.

I claim:

1. A violin, cello or viola, comprising:

a) a body which comprises a baseball bat with a handle and a head, b) a fingering region consisting of the handle of said baseball bat and c) a plurality of strings which extend along the fingering region which are removably attached to said body by holes in a baseball bat handle to secure the ball-end of the strings and tuner pegs positioned in the bat head.

2. A string instrument as in claim 1 which additionally comprises a bridge mounted to the body at a position between the two points of attachment of the plurality of strings below the fingering region with one side adjacent the finger board and another side opposite the finger board, wherein said bridge has a top in contact with said plurality of strings so as to maintain them in a position where they do not press down on the fingering region without external pressure.

3. The violin, cello or viola of claim 1 which additionally comprises an electric pick-up connected to said body so as to receive sounds from the plurality of strings and transmit them to an amplifier.

4. The violin, cello or viola of claim 1 which additionally comprises a nut mounted on the body at the location where the strings are attached to said body.

5. The violin, cello or viola of claim 3 wherein the electric pick-up is a magnetic pick-up.

6. The violin, cello or viola of claim 3 wherein the electric pick-up is a wireless pick-up transmitter.

* * * * *